United States Patent [19]

Fuse et al.

[11] Patent Number: 5,045,421

[45] Date of Patent: Sep. 3, 1991

[54] ELECTROPHOTOGRAPHIC PHOTORECEPTOR COMPRISING METAL COMPLEX CHARGE TRANSPORT MATERIAL

[75] Inventors: Masahiro Fuse, Machida; Hiromi Horiuchi, Tokyo; Shigenori Otsuka, Omiya, all of Japan

[73] Assignee: Mitsubishi Kasei Corporation, Tokyo, Japan

[21] Appl. No.: 570,155

[22] Filed: Aug. 17, 1990

[30] Foreign Application Priority Data

Aug. 22, 1989 [JP] Japan ..... 64-215797

[51] Int. Cl.[5] ..... G03G 5/14

[52] U.S. Cl. ..... 430/58; 252/500

[58] Field of Search ..... 430/56, 57, 58, 59

[56] References Cited

U.S. PATENT DOCUMENTS 3,871,882 3/1975 Wiedemann ..... 430/59

4,407,919 10/1983 Murayama et al. ..... 430/58

4,795,689 1/1989 Matsubara ..... 430/109

*Primary Examiner*—David Welsh

*Attorney, Agent, or Firm*—David G. Conlin; Gregory D. Williams

[57] ABSTRACT

Disclosed herein is an electrophotographic photoreceptor having on a conductive base at least one charge generation layer and at least one charge transport layer, the charge transport layer containing a metal complex or salt of an aromatic carboxylic acid represented by the following general formula (I):

$$\mathrm{ArCOOH} \qquad (I)$$

wherein Ar is an aromatic cyclic residue or an aromatic heterocyclic residue, optionally having one or more substituents. The electrophotographic photoreceptor according to the present invention has the excellent durability.

15 Claims, No Drawings

ELECTROPHOTOGRAPHIC PHOTORECEPTOR COMPRISING METAL COMPLEX CHARGE TRANSPORT MATERIAL

FIELD OF THE INVENTION

The present invention relates to an electrophotographic photoreceptor. More particularly, it relates to the electrophotographic photoreceptor having an excellent durability.

BACKGROUND OF THE INVENTION

In recent years, the electrophotography has been applied to copying machines as well as various printers since they can give images with high qualities without delay. As a photoreceptor which plays an important role in the electrophotography, the photoreceptor comprising an inorganic photoconductive material such as selenium, arsenic-selenium alloy, cadmium sulfide, zinc oxide and the like has been used. More recently, the photoreceptor comprising an organic photoconductive material was proposed. The latter has the advantages which is not a pollutant and which has a film-formability and a shapability.

As one of the organic photoreceptors, the so-called "laminated-type photoreceptor" in which a charge generation layer and a charge transport layer are successively laminated was developed. The laminated-type photoreceptor is increasingly interested in and is expected to be widely used in the near future because it has the following advantages:

(1) the photoreceptor having high sensitivity can be obtained by suitably selecting and combining the charge generation material and the charge transport material;

(2) the photoreceptor having high safety can be obtained because the charge generation material and the charge transport material can be selected from a wide range of the materials; and (3) the photoreceptor can be prepared by simple coating and thus it can be prepared with low costs.

However, the prior laminated-type photoreceptors have poor durability. When they are repeatedly used, the electric problems such as the lowering of the charged potential, the accumulation of the residual potential and the change in the sensitivity are caused. The problem as to the accumulation of the residual potential is especially serious because if the residual potential is accumulated, much copies could not be obtained. Such an accumulation of the residual potential is considered to arise from some causes, among which impurities present in the charge transport layer are important. The impurities include impurities originally present in a composition used for forming the charge transport layer, impurities produced after the charge transport layer is subjected to a corona discharge and impurities produced by the decomposition after the charge transport layer is exposed repeatedly during an exposure step and an erasing step and after the charge transport layer is subjected to an outside light during a maintenance operation. These impurities trap carriers so as to produce unmovable space charges which remain as the residual charges in the charge transport layer.

As the other cause of lowering the durability of the laminated-type photoreceptor, the reduction in thickness of the charge transport layer due to mechanical stresses, for example an abrasion such as blade cleaning to lead the lowering of electric properties is mentioned.

The increase of the thickness of the charge transport layer is effective for preventing the reduction in thickness of the charge transport layer and increasing the sensitivity of the photoreceptor, but it is accompanied with the increase of the amounts of impurities so that the accumulation of the residual potential makes more remarkable.

For preventing the accumulation of the residual potential caused by the impurities present in the charge transport layer, an addition of a specific compound in the charge transport layer is attempted. However, the prior known compounds are not satisfactory because they prevent the accumulation of the residual potential insufficiently and they affect the electric properties including the charge-ability and sensitivity.

The present inventors have been investigated the specific compound which can prevent the accumulation of the residual potential sufficiently without affecting the electric properties and now they found that metal complexes or salts of a carboxylic acid in which the group "—COOH" directly connects with an aromatic ring satisfy the above requirements.

SUMMARY OF THE INVENTION

According to the present invention, an electrophotographic photoreceptor has on a conductive base at least one charge generation layer and at least one charge transport layer, the charge transport layer containing a metal complex or salt of an aromatic carboxylic acid represented by the following general formula (I):

$$\mathrm{ArCOOH} \qquad (I)$$

wherein Ar is an aromatic homocyclic residue or an aromatic heterocyclic residue, optionally having one or more substituents.

DETAILED DESCRIPTION OF THE INVENTION

The photoreceptor according to the present invention has the conductive base, on which the photosensitive layer comprising the charge generation layer and the charge transport layer is provided. As the conductive base, any of the known conductive photoreceptor can be used. Examples of the conductive base include a base made of a metallic material such as aluminium, stainless steel, copper and nickel and a base made of an insulating material such as polyester film or paper on which has a conductive layer such as polyester film or paper on which has a conductive layer such as a layer of aluminium, copper, palladium, tin oxide or indium oxide.

A known barrier layer may be provided between the conductive base and the charge generation layer, as generally used in the photoreceptor. As the barrier layer, a layer of an inorganic material such as aluminium anodic oxide film, aluminium oxide and aluminium hydroxide or a layer of an organic material such as polyvinyl alcohol, casein, polyvinyl pyrrolidone, polyacrylic acid, celluloses, gelatin, starch, polyurethane, polyimide and polyamide is used.

The charge generation layer comprises a charge generation material. As the charge generation material used in the charge generation layer, various inorganic photoconductive materials such as selenium or its alloys, arsenic-selenium alloy, cadmium sulfide and zinc oxide or various organic pigments or dyes such as phthalocyanine, azo, quinacridone, polycyclic quinone, pyrylium salt, thiapyrylium salt, indigo, thioindigo, anthoanthrone, pyranthrone and cyanine can be used. Among them, phthalocyanine without metal, phthalocyanines coordinated with metal or its compound such as copper, indium chloride, gallium chloride, tin, oxytitanium, zinc and vanadium, azo pigments such as monoazo, bisazo, trisazo and polyazo are preferable.

The charge generation material described above can be used in the charge generation layer together with any of the binder resins such as polyester resin, polyvinyl acetate, polyacrylate, polymethacrylate, polyester, polycarbonate, polyvinyl acetoacetal, polyvinyl propional, polyvinyl butyral, phenoxy resin, epoxy resin, urethane resin, cellulose ester and cellulose ether.

The charge generation material is preferably used in an amount of 30 to 500 parts by weight per 100 parts by weight of the binder resin.

If necessary, the charge generation layer may contain various additives such as a leveling agent, an antioxidant and a sensitizer.

The charge generation layer is usually formed on the conductive base according to any one of the known methods, preferably a coating method wherein a coating solution containing the charge generation material and the binder resin together with any optional additives in a suitable solvent is coated. Alternatively, the charge generation layer may be formed by directly depositing the charge generation layer on the conductive base.

The thickness of the charge generation layer is generally 0.1 to 2 μm, preferably 0.15 to 0.8 μm.

The charge transport layer contains the specific compound, a charge transport material and a binder resin. The compound used in the charge transport layer is the metal complex or salt of the aromatic carboxylic acid represented by the general formula (I):

ArCOOH (I)

wherein Ar is the residue of the aromatic homocyclic (or carbon cyclic) compound such as benzene, naphthalene or anthracene or the residue of the aromatic heterocyclic compound such as carbazole. Ar has optionally one or more substituents such as alkyl, aryl, hydroxy, alkoxy, aryloxy, alkylcarbonyl, arylcarbonyl, alkoxycarbonyl, aryloxycarbonyl, carboxyl, nitro, cyano, halogen, among which hydroxy is preferable.

As the aromatic carboxylic acid (I), the carboxylic acid represented by the general formula (II) is preferable.

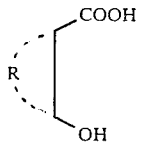

(II)

wherein R is atoms forming the aromatic carbon ring or the aromatic heterocyclic ring, which may have the same substituents as in Ar.

The representative aromatic carboxylic acid (I) are exemplified below.

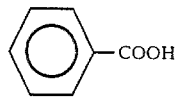

(1)

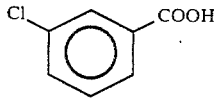

(2)

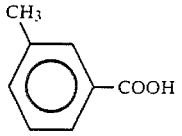

(3)

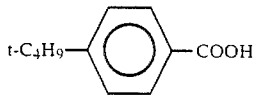

(4)

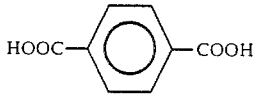

(5)

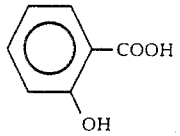

(6)

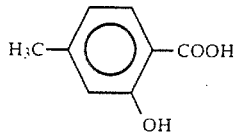

(7)

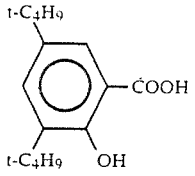

(8)

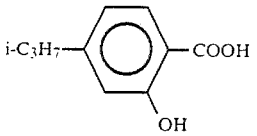

(9)

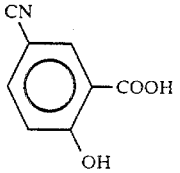

(10)

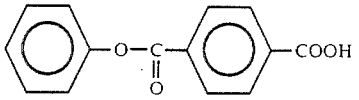

(11)

-continued (12)

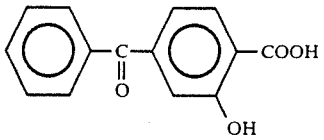

(13)

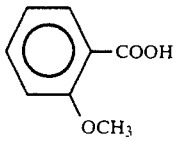

(14)

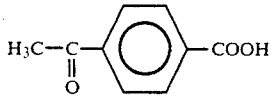

(15)

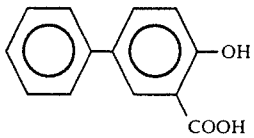

(16)

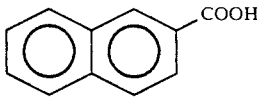

(17)

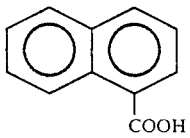

(18)

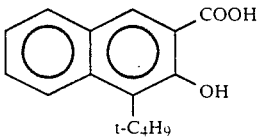

(19)

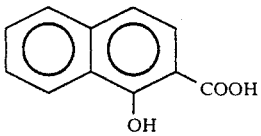

(20)

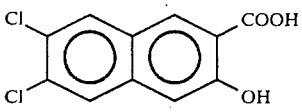

(21)

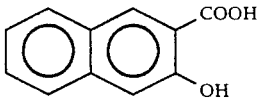

(22)

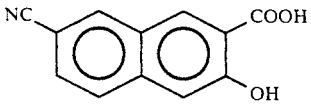

(23)

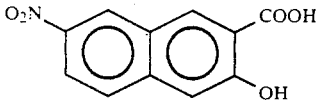

-continued (24)

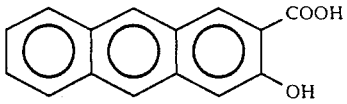

(25)

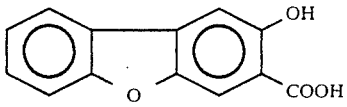

(26)

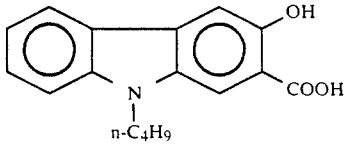

Any metal capable of forming the metal complex or salt with the aromatic carboxylic acid is used in the present invention. Although any metal belonging to the typical elements or any metal belonging to the transition elements is usable, aluminium, zinc, chromium, cobalt, nickel and iron are especially preferable.

As the metal complex or salt used in the present invention, the commercial products in the trade names of Bontron E-§1, Bontron E-84 and Bontron E-88 (ex ORIENT KAGAKU KABUSHIKI KAISHA) are mentioned. Alternatively, the metal complex or salt used in the present invention can be prepared according to any of the known methods. For example, the aromatic carboxylic acid or metal salt of aromatic carboxylic acid may be treated with a soluble salt such as sulfate, nitrate or chloride of the above metal in water and/or alcohol so as to obtain the objective metal complex or salt. Any other methods describe in the publication (see J. L. CLARK and H. KAO, "J. Amer. Chem. Soc." 70, 2151(1948); Japanese Patent Application Laying-Open (KOKAI) No. 53-127726; Japanese Patent Application Laying-Open (KOKAI) No. 57-104940; Japanese Patent Application Laying-Open (KOKAI) No. 55-42752; Japanese Patent Application Laying-Open (KOKAI) No. 59-79256) For example, according to the method of J. L. CLARK and H. KAO, "J. Amer. Chem. Soc." 70, 2151(1948), a solution containing 2 moles of sodium salicylate and a solution containing 1 mole of zinc chloride are mixed with stirring at room temperature so as to obtain the zinc salt of salicylic acid which perhaps has the following structure (A), as a white powder. This method can be applied to the other aromatic carboxylic acids and other metals.

(A)

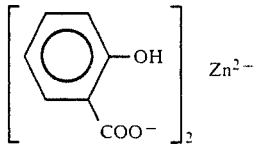

According to the method of Japanese Patent Laying-Open (KOKAI) No. 53-127726, a solution of 3,5-di-t-butyl salicylate in methanol and an aqueous solution of $Cr_2(SO_4)_3$ are mixed followed by adjusting the pH value to be 4 to 5 using a sodium hydroxide solution and refluxing so as to obtain a chromium complex of 3,5-di-t-butyl salicylic acid which perhaps has the following structure (B), as a pale green precipitate. This method can be applied to the other carboxylic acids and other metals.

(B)

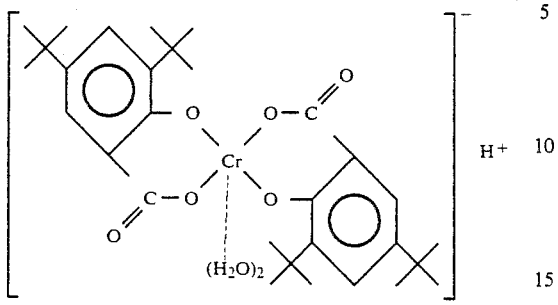

The charge transport material used together with the specific metal complex or salt in the charge transport layer is an electron donative material, the examples of which include heterocyclic compounds such as carbazole, indole, imidazole, oxazole, pyrazole, oxadiazole, pyrazoline and thiadiazole, aniline derivatives, hydrazone compounds, aromatic amine derivatives, stilbene derivatives and polymers having the above compound in the main chain or the side chain.

As the binder resin used together with the specific metal complex or salt and the charge transport material in the charge transport layer, a vinyl polymer such as polymethyl methacrylate, polystyrene and polyvinyl chloride and its copolymer, polycarbonate, polyester, polyester carbonate, polysulfone, polyimide, phenoxy, epoxy and silicone resins can be used. Their partially crosslinked products may be used.

The specific metal complex or salt is generally used in an amount of 0.001 to 10 parts by weight, preferably 0.01 to 2 parts by weight per 100 parts by weight of the binder resin. The charge transport material is generally used in an amount of 30 to 200 parts by weight, preferably 40 to 120 parts by weight per 100 parts by weight of the binder resin.

If necessary, the charge transport layer may contain various additives such as an antioxidant and a sensitizer.

The charge transport layer is usually formed on the charge generation layer according to any one of the known methods, preferably the coating method wherein the coating solution containing the specific metal complex or salt, the charge transport material and the binder resin together with any optional additives in a suitable solvent is coated.

The thickness of the charge transport layer is generally 10 to 60 μm, preferably 10 to 45 μm.

The electrophotographic photoreceptor described in the above has the conductive base on which the charge generation layer and further the charge transport layer are provided, but the order of laminating the charge generation layer and the charge transport layer may be changed, if necessary.

EFFECT OF THE INVENTION

The electrophotographic photoreceptor containing the specific metal complex or salt in the charge transport layer according to the present invention shows the low residual potential. It hardly shows the accumulation of the residual potential and the change in the sensitivity, and is excellent in the charge-ability , even if used repeatedly.

EXAMPLES

The invention will be better understood by reference to certain examples, which are included herein for purposes of illustration only and are not intended to limit the invention.

EXAMPLE 1

10 parts by weight of a bisazo compound having the following formula:

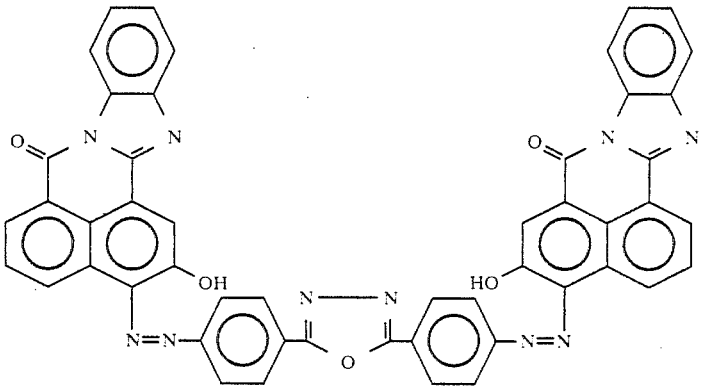

were added to 150 parts by weight of 4-methoxy-4-methylpentanone-2 and they were subjected to the grinding and dispersion treatment with a sand grind mill. The thus obtained dispersion was added to 100 parts by weight of a 5% solution of polyvinyl butyral (#6000-C (trade name), ex DENKI KAGAKU KOGYO KABUSHIKI KAISHA) in 1,2-dimethoxyethane and further 1,2-dimethoxyethane was added so as to prepare a dispersion with a solid concentration of 4.0%.

In the above dispersion, an aluminium cylinder having a mirror finished surface and having the outer diameter of 80 mm, the length of 340 mm and the thickness of 1.0 mm was immersed for coating the charge generation layer on the aluminium cylinder so as to provide a dried film of 0.3 μm in thickness.

This aluminium cylinder was immersed in a solution of 95 parts by weight of a hydrazone compound having the following formula:

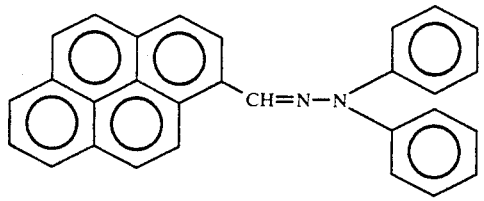

0.20 part by weight of a zinc salt of the aromatic carboxylic acid (No. 6) and 100 parts by weight of a polycarbonate resin (viscosity-average molecular weight: about 22,000) having the following formula:

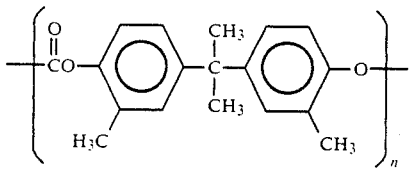

in a mixed solvent of 1,4-dioxane and tetrahydrofuran (volume ratio of 65:35) for coating the charge transport layer on the charge generation layer and dried at room temperature for 30 minutes and then at 125° C. for 30 minutes so as to to provide a dried film of 40 μm in thickness.

In this way, a laminated-type electrophotographic photoreceptor (sample 1A) was prepared.

The procedures in Example 1 were repeated, except that the zinc salt was replaced with other metal complexes or salts shown in Table 1 in amounts shown in Table 1 so as to prepare the photoreceptors (1B–1H).

Comparative Example 1

The procedure in Example 1 was repeated, except that the zinc salt was omitted so as to prepare the photoreceptor (comparative sample 1A).

Comparative Example 1'

The procedure in Example 1 was repeated, except that the zinc salt was replaced with the aromatic carboxylic acid (No. 8) so as to prepare the photoreceptor (comparative sample 1B).

Test Example

The characteristics of the photoreceptors prepared in Example 1 and Comparative Examples 1 and 1' were tested.

Each photoreceptor was charged at 260 mm/sec (the surface potential at this time was -700 V) followed by exposing and erasing. Then, the initial potential and the residual potential were determined.

Further the above cycle of charging, exposing and erasing was repeated 300,000 times and then the initial potential and the residual potential were determined.

The results are shown in Table 1.

TABLE 1

| | metal complex or salt | | initial | | after 300,000 times | |
|---|---|---|---|---|---|---|
| sample | nature | amount (pbw) | initial potential | residual potential | initial potential | residual potential |
| 1A | Zn salt of compound No. 6 | 0.20 | −700 V | −10 V | −725 V | −60 V |
| 1B | Cr (III) complex of compound No. 8 | 0.38 | −700 V | −5 V | −700 V | −45 V |
| 1C | Al salt of compound No. 8 | 0.39 | −700 V | −15 V | −750 V | −80 V |
| 1D | Zn salt of compound No. 8 | 0.36 | −700 V | −10 V | −725 V | −55 V |
| 1E | Co (III) complex of compound No. 18 | 0.48 | −700 V | −10 V | −725 V | −65 V |
| 1F | Zn salt of compound No. 21 | 0.40 | −700 V | −10 V | −730 V | −70 V |
| 1G | Cr (III) complex of compound No. 23 | 0.45 | −700 V | −10 V | −710 V | −50 V |
| 1H | Cr (III) complex of compound No. 25 | 0.50 | −700 V | −10 V | −710 V | −50 V |
| com. 1A | — | — | −700 V | −55 V | −850 V | −480 V |
| com. 1B | compound No. 8 | 0.88 | −700 V | −30 V | −820 V | −400 V |

As clear from the results in Table 1, in the electrophotographic photoreceptors comprising the specific metal complex or salt in the charge transport layers according to the present invention, the initial potential hardly changed and the accumulation of the residual potential was ignorable after using 300,000 times. On the other hand, in the electrophotographic photoreceptor without the specific metal complex or salt, the residual potential was remarkably accumulated. Thus, it can be said that the electrophotographic photoreceptor according to the present invention has the excellent durability.

Example 2

10 parts by weight of an oxytitanium phthalocyanine were added to 200 parts by weight of dimethoxyethane and they were subjected to the grinding and dispersion treatment with a sand grind mill. The thus obtained dispersion was added to a solution containing 5 parts by weight of polyvinyl butyral resin (#6000-C (trade name), ex DENKI KAGAKU KOGYO KABUSHIKI KAISHA) in 100 parts by weight of dimethoxyethane so as to prepare a dispersion.

The above dispersion was coated on a polyester film having 75 μm in thickness on which aluminium was deposited for forming the charge generation layer so as to provide a dried film of 0.3 μm in thickness.

On this charge generation layer, a solution containing 80 parts by weight of a hydrazone compound having the following formula:

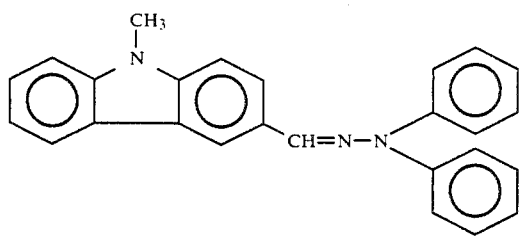

20 part by weight of a hydrazone compound having the following formula:

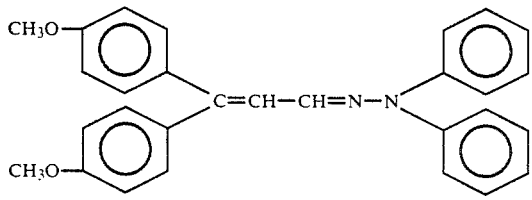

100 parts by weight of a polycarbonate resin (NOVALEX 7030 A, ex MITSUBISHI KASEI CORPORATION) and 0.38 parts by weight of a Cr(III) complex of the aromatic carboxylic acid (No. 8) in 670 parts by weight of dioxane was coated for forming the charge transport layer so as to provide a dried film of 17 μm in thickness.

In this way, a laminated-type electrophotographic photoreceptor (sample 2A) was prepared.

The procedures in Example 2 were repeated, except that the chromium complex was replaced with other metal complexes or salts shown in Table 2 in amounts shown in Table 2 so as to prepare the photoreceptors (2B–2C).

Comparative Example 2

The procedure in Example 2 was repeated, except that the chromium complex was omitted so as to prepare the photoreceptor (comparative sample 2).

Test Example

The characteristics of the photoreceptors prepared in Example 2 and Comparative Example 2 were tested.

Each photoreceptor was charged (the applied voltage was controlled so that the corrona current in the dark was 22 μA) followed by exposing and erasing (100 lux, 2 sec). Then, the initial potential and the residual potential were determined.

Further the above cycle of charging, exposing and erasing was repeated 2,000 times and then the dark potential and the residual potential were determined.

The results are shown in Table 2.

TABLE 2

| | metal complex or salt | | initial | | after 2,000 times | |
|---|---|---|---|---|---|---|
| sample | nature | amount (pbw) | initial potential | residual potential | initial potential | residual potential |
| 2A | Cr (III) complex of compound No. 8 | 0.38 | −628 V | −3 V | −632 V | −7 V |
| 2B | Al salt of compound No. 8 | 0.39 | −647 V | −5 V | −645 V | −10 V |
| 2C | Zn salt of compound No. 8 | 0.36 | −655 V | −5 V | −658 V | −11 V |
| com. 2 | — | — | −670 V | −10 V | −805 V | −52 V |

As clear from the results in Table 2, in the electrophotographic photoreceptors containing the specific metal complex or salt in the charge transfer layers according to the present invention, the dark potential hardly changed and the accumulation of the residual potential was ignorable after using 2,000 times. On the other hand, in the electrophotographic photoreceptor without the specific metal complex or salt, the residual potential was remarkably accumulated. Thus, it can be said that the electrophotographic photoreceptor according to the present invention has the excellent durability.

What is claimed is:

1. An electrophotographic photoreceptor having on a conductive base at least one charge generation layer and at least one charge transport layer, the charge transport layer containing a metal complex or salt of an aromatic carboxylic acid represented by the following general formula (I):

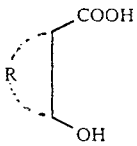

(I)

wherein Ar is an aromatic homocyclic residue or an aromatic heterocyclic residue, optionally having one or more substituents.

2. The photoreceptor according to claim 1, wherein the aromatic carboxylic acid is represented by the following general formula (II):

(II)

wherein R is atoms forming an aromatic carbon ring or an aromatic heterocyclic ring, optionally having one or more substituents.

3. The photoreceptor according to claim 1, wherein the metal complex or salt of the aromatic carboxylic acid is that of the aromatic carboxylic acid (I) with at least one metal selected from the group consisting of aluminium, zinc, chromium, nickel and iron.

4. The photoreceptor according to claim 1, wherein the charge transport layer comprises the metal complex or salt of the aromatic carboxylic acid (I), a charge transport material and a binder resin.

5. The photoreceptor according to claim 4, wherein the charge transport material is at least one electric donative material selected from the group consisting of heterocyclic compounds, aniline derivatives, hydrazone compounds, aromatic amine derivatives, stilbene derivatives and polymers having the above compound in the main chain or the side chain.

6. The photoreceptor according to claim 4, wherein the binder resin is at least one selected from the group consisting of a vinyl polymer such as polymethyl methacrylate, polystyrene and polyvinyl chloride and its copolymer, polycarbonate, polyester, polyester carbonate, polysulfone, polyimide, phenoxy, epoxy and silicone resins and their partially crosslinked products.

7. The photoreceptor according to claim 4, wherein the metal complex or salt of the aromatic carboxylic acid (I) is contained in an amount of 0.001 to 10 parts by weight per 100 parts by weight of the binder resin.

8. The photoreceptor according to claim 7, wherein the metal complex or salt of the aromatic carboxylic acid (I) is contained in an amount of 0.01 to 2 parts by weight per 100 parts by weight of the binder resin.

9. The photoreceptor according to claim 4, wherein the charge transport material is contained in an amount of 30 to 200 parts by weight per 100 parts by weight of the binder resin.

10. The photoreceptor according to claim 9, wherein the charge transport material is contained in an amount of 40 to 120 parts by weight per 100 parts by weight of the binder resin.

11. The photoreceptor according to claim 1, wherein the thickness of the charge transport layer is 10 to 60 μm.

12. The photoreceptor according to claim 11, wherein the thickness of the charge transport layer is 10 to 45 μm.

13. The photoreceptor according to claim 1, wherein the metal complex or salt of the aromatic carboxylic acid (I) is obtained by reacting the aromatic carboxylic acid (I) or its salt with a soluble metal salt in water and/or alcohol.

14. The photoreceptor according to claim 13, wherein the soluble metal salt is at least one selected from the group consisting of nitrate, sulfate and chloride.

15. The photoreceptor according to claim 13, wherein the soluble metal salt is that of at least one metal selected from the group consisting of aluminium, zinc, chromium, cobalt, nickel and iron.

* * * * *